US011059302B2

(12) United States Patent
Lin et al.

(10) Patent No.: US 11,059,302 B2
(45) Date of Patent: Jul. 13, 2021

(54) THERMAL PRINTER

(71) Applicant: XIAMEN HANIN ELECTRONIC TECHNOLOGY CO., LTD., Xiamen (CN)

(72) Inventors: Jinyi Lin, Xiamen (CN); Zhiping Liu, Xiamen (CN)

( * ) Notice: Subject to any disclaimer, the term of this patent is extended or adjusted under 35 U.S.C. 154(b) by 0 days.

(21) Appl. No.: 16/867,729

(22) Filed: May 6, 2020

(65) Prior Publication Data

US 2021/0094316 A1 Apr. 1, 2021

(30) Foreign Application Priority Data

Sep. 30, 2019 (CN) ..... 201910944526.8

(51) Int. Cl.

| | |
|---|---|
| ***B41J 25/312*** | (2006.01) |
| ***B41J 25/316*** | (2006.01) |
| ***B41J 2/32*** | (2006.01) |
| ***B41J 11/04*** | (2006.01) |
| ***B41J 29/38*** | (2006.01) |
| ***B41J 13/22*** | (2006.01) |
| ***B41J 13/02*** | (2006.01) |

(52) U.S. Cl.

CPC ..... *B41J 2/32* (2013.01); *B41J 11/04* (2013.01); *B41J 13/02* (2013.01); *B41J 13/22* (2013.01); *B41J 25/312* (2013.01); *B41J 25/316* (2013.01); *B41J 29/38* (2013.01)

(58) Field of Classification Search

CPC ..... B41J 25/304; B41J 25/312; B41J 25/316; B41J 2/32; B41J 11/04; B41J 29/38; B41J 13/22; B41J 13/02

See application file for complete search history.

(56) References Cited

U.S. PATENT DOCUMENTS 4,830,523 A * 5/1989 Sparer ..... B41J 25/312 400/120.16
5,366,302 A * 11/1994 Masumura ..... B41J 25/316 347/197

(Continued)

FOREIGN PATENT DOCUMENTS

JP 10-181148 * 7/1998 ..... B41J 25/312

OTHER PUBLICATIONS

Machine translation of JP 10-181148, published on Jul. 1998.*

*Primary Examiner* — Huan H Tran
(74) *Attorney, Agent, or Firm* — The Law Office of Austin Bonderer, PC; Austin Bonderer

(57) ABSTRACT

A thermal printer comprises a base part, a holding member, a printing device and a platen roller. When an uneven pressing force is applied to the printing device by the recording paper sheet, the printing device is capable of swinging about the support pin serving as a fulcrum in order to even out the pressing force. The deformable mechanism is capable of being plastically deformed to keep the position of the printing device. An elastic element is disposed between the holding member and the base part, and due to the elastic element, both the printing device and the platen roller are in close contact with the recording paper sheet when the recording paper sheet is clamped between the printing device and the platen roller. The printing force of the printing device acting on the printing paper sheet can be distributed more even to achieve clearer printing.

14 Claims, 3 Drawing Sheets

(56) References Cited

U.S. PATENT DOCUMENTS

| | | | | |
|---|---|---|---|---|
| 5,694,159 | A * | 12/1997 | Kajiya | B41J 2/32 347/197 |
| 7,889,218 | B2 * | 2/2011 | Yamamoto | B41J 2/32 347/198 |
| 2013/0176373 | A1 * | 7/2013 | Huang | B41J 2/32 347/198 |
| 2018/0022111 | A1 * | 1/2018 | Yoon | B41J 2/33505 347/174 |
| 2018/0022115 | A1 * | 1/2018 | Yoon | B41J 25/312 347/220 |
| 2020/0207124 | A1 * | 7/2020 | Abe | B41J 2/32 |

* cited by examiner

THERMAL PRINTER

CROSS-REFERENCE TO RELATED APPLICATIONS

The present application claims the benefit under 35 U.S.C. § 119 of China Patent Application No. 201910944526.8, filed on Sep. 30, 2019, in the China National Intellectual Property Administration, the content of which is hereby incorporated by reference.

FIELD OF THE INVENTION

The present disclosure relates to the technical field of printers, more particularly to a thermal printer.

BACKGROUND OF THE INVENTION

The thermal printer, which is conventional printing equipment, is continuously technically upgraded for years and is well improved. As printing quality requirements continue to become ever more demanding, higher requirements are imposed on the improvement. To improve the printing quality, the applicant DS GLOBAL filed a patent application No. 201710598703.2 entitled Photo Printer and published on Jan. 30, 2018, which discloses a photo printer. The photo printer is configured for applying heat corresponding to a given temperature to paper sheets which are capable of being colored in response to heating to realize image or text printing. The photo printer is characterized by comprising a base adapted to accommodating the paper sheet therein, a pickup, a platen roller, a head and a swing bracket. The pickup roller protrudes from the bottom of the base to feed the paper sheet accommodated in the base forwardly. The platen roller is disposed in front of the base to discharge the paper sheet fed by the pickup roller forwardly. The head is located above the platen roller to apply the given heat to the paper sheet, The swing bracket has a mounting portion formed at the front side thereof in such a manner as to be coupled to the head, and engagement portions formed at the rear side thereof in such a manner as to be rotatably engaged with the base to allow the head to swinging; and pressurizing means adapted to pressurize the head downwardly to allow the head to come into close contact with the paper sheet advancing into the space between the head and the platen roller.

According to the abovementioned application, the rotation of the swing bracket is located more rearwardly than the rotation shaft of the platen roller. In such a case, due to the pressing force applied on the head during feeding of paper sheets, the head can be rotated easily, and the compression of the platen roller can be minimized. In this way, paper sheets and the platen roller are linearly contacted sufficiently and printing quality can be improved.

According to the abovementioned application, when the paper sheet is fed to the platen roller and the head, the head may swing due to the deviation of force applied to the head caused by spring tension difference and paper thickness between the two sides. The position changes after the swinging and different heats provided in the printing process may lead to different supporting forces on the left and right sides. In such a case, the print line may be offset due to the dynamically adjusted position of the head. In particular, it is described as follows. Referring to FIG. 1, when the head (thermal head) heats a paper sheet (when relatively deeper black is printed continuously), the corresponding area of the printing paper sheet has increased temperature. It gets hot, the frictional drag f1 generated during the frontward transmission of the printing paper sheet is increased, then the force applied by the platen roller to transmit the printing paper sheet is increased, and accordingly, the reactive force f2 is increased. Since the platen roller is surrounded by the colloid which has a circular cross-section and can be deformed (referring to FIG. 1) when the reactive force f2 is increased, the head according to the abovementioned application may be moved downwardly due to the force F applied by the pressing element, such that the heating unit of the head may be displaced from the original position, and the supporting force F1 may be displaced to the position of F2. When the force generated depending on the deformation amount of the colloid equals the product of the supporting force and the friction coefficient, the deformation of the colloid disappears, and the head can have a stable position. In such a case, the resulting printing quality may be affected by the offset of the print line.

SUMMARY OF THE INVENTION

The present disclosure provides a thermal printer, which comprises a base part, a holding member, a printing device and a platen roller. The holding member is arranged on the base part. The printing device is disposed along a width direction of a recording paper sheet. The platen roller and the printing device are oppositely disposed and are capable of performing rotation to feed the recording paper sheet clamped therebetween. A front end of the printing device is connected with the holding member by a support pin. A rear end thereof is connected with the holding member by a deformable mechanism. And when a pressing force applied to the printing device by the recording paper sheet is uneven, the printing device is capable of swinging about the support pin serving as a fulcrum in order to even out the pressing force. The deformable mechanism is capable of being plastically deformed to keep the position of the printing device. An elastic element is disposed between the holding member and the base part. When the recording paper sheet is clamped between the printing device and the platen roller, both the printing device and the platen roller are in close contact with the recording paper sheet due to the elastic element.

In some embodiments, the printing device comprises a swing element and a thermal head, a front end of the swing element is connected with the holding member by the support pin, a rear end of the swing element is connected with the holding member by the deformable mechanism, the swing element is capable of swinging about the support pin serving as the fulcrum when an uneven pressing force is applied to the thermal head by the recording paper sheet, in order to even out the pressing force, and the deformable mechanism is capable of being plastically deformed to keep a position of the swing element.

In some embodiments, a support section of the support pin between the holding member and the swing element is adjustably located therebetween to change a pre-tensioning force between the swing element and the holding member.

In some embodiments, the support pin is adjustably arranged on the holding member by a thread structure.

In some embodiments, the support pin is located between the holding member and the swing element. The support pin is arranged on one of the holding member and the swing element and protrudes towards the other one of the holding member and the swing element, in order to form the fulcrum for the support pin.

In some embodiments, the deformable mechanism comprises a deformable portion and a connecting portion for connecting the holding member and the swing element. The deformable portion is configured to be plastically deformed to keep a swing position of the swing element when the swing element swings.

In some embodiments, the deformable mechanism is arranged on the holding member and includes a connecting portion and a deformable portion, which are formed by hollowed-cuts of the holding member. And the rear end of the swing element is fixed on the connecting portion.

In some embodiments, in a state where there is no recording paper sheet clamped between the thermal head and the platen roller. The thermal head is parallel to an axis of the platen roller. The thermal head is located at an original position. The deformable mechanism is configured to be plastically deformed to allow the thermal head to return back to the original position under an effect of an engagement element when the recording paper sheet is moved away from a position between the thermal head and the platen roller.

In some embodiments, a gap between the thermal head and the platen roller can be adjusted by a thread structure of the engagement element.

In some embodiments, the engagement element is configured to keep a determined gap between the thermal head located at the original position and the platen roller.

In some embodiments, a pivoting portion pivotably connected with the base part is arranged at a rear end of the holding member. The elastic element is configured to apply force to the holding member towards the platen roller to press the printing device and allow the printing device to get in close contact with the recording paper sheet.

In some embodiments, the platen roller is movably arranged on the base part, and the elastic element is configured to apply force to the platen roller towards the printing device to allow it to get in close contact with the recording paper sheet.

In some embodiments, the elastic element is a pressure spring. The holding member is arranged with a first pressure spring mounting portion for mounting the pressure spring. The base part is arranged with a second mounting portion for mounting the pressure spring. The pressure spring is located between the first pressure spring mounting portion and the second mounting portion.

In some embodiments, the first pressure spring mounting portion is formed by a mounting frame which is hollowed out. The second mounting portion is disposed at the upper end in the mounting frame. The second mounting portion extends through the mounting frame to provide a space for mounting the pressure spring.

The technical solution of the present disclosure has advantages as follows.

1. In the present disclosure, due to the corporation of the support pin and the deformable mechanism, the printing device can be self-adaptively adjusted depending on the force transferred by the printing paper sheet. In this way, during the printing process, the printing force can be distributed more evenly and better printing effect can be achieved.

2. In addition, since the deformable mechanism may be plastically deformed, the printing device can remain in place due to plastic deformation when the colloid of the platen roller is partially deformed by the reactive force, whereby the heating line of the printing device printing on the printing paper sheet can be stable, and the printing quality can be improved.

3. With the arrangement that the holding member or the platen roller is movably arranged on the base part, in the case that various forces may be transferred by the paper, the printer can be better adapted to provide the printing gap for facilitating the printing.

4. Since the support section of the support pin between the holding member and the printing device can be adjusted therebetween, the pre-tensioning force between the printing device and the holding member can be changed, whereby the printing device can be better self-adaptively adjusted when an uneven force is applied.

5. Due to the engagement element arranged on the printer, once the printer finishes the printing process and the printing paper sheet is departed from the platen roller, the deformable mechanism can be reset under the effect of the support pin serving as the fulcrum.

6. Due to the pressure spring for applying force to the holding member, a small printer can have high sensitivity to provide the elastic force by the pressure spring.

DETAILED DESCRIPTION OF ILLUSTRATED EMBODIMENTS

In order to make the purpose, technical solution and advantages of embodiments of the present disclosure clearer, the embodiments of the present disclosure will be described more completely and clearly below in conjunction with the accompanying drawings illustrating the embodiments. It is apparent that the embodiments described below are merely some, but not all, embodiments of the present disclosure. Based on the embodiments of the present disclosure, those skilled in the art may obtain other embodiments included within the scope of the present disclosure without any creative work. Therefore, the detailed description of embodiments of the present disclosure illustrated in the accompanying drawings is not intended to limit the scope of the disclosure, but rather illustrates particular embodiments of the present disclosure. Based on the embodiments of the present disclosure, those skilled in the art may obtain other embodiments included within the scope of the present disclosure without any creative work.

First Embodiment

Figure 2:
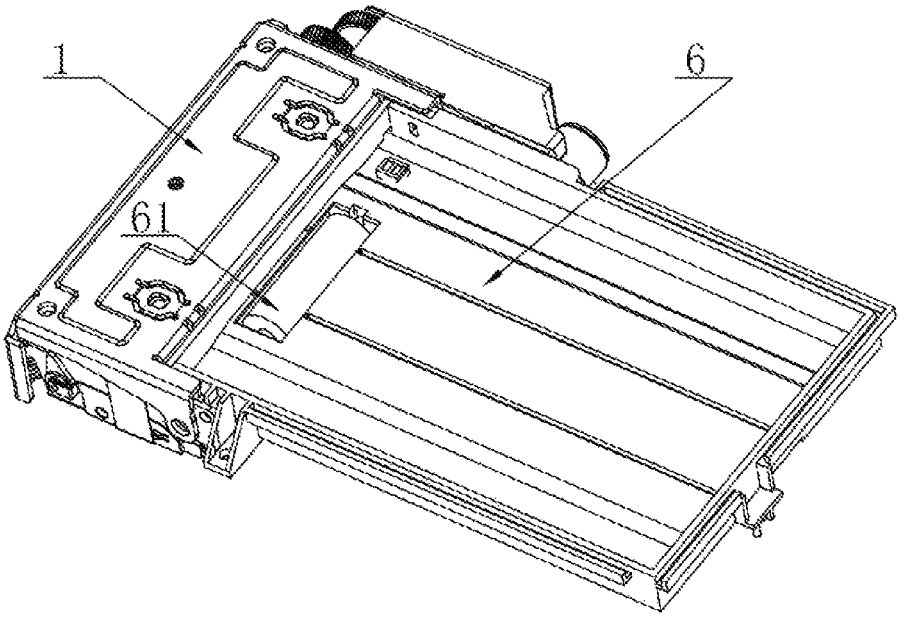
FIG. 2 is a perspective view according to a first embodiment of the present disclosure.
Figure 3:
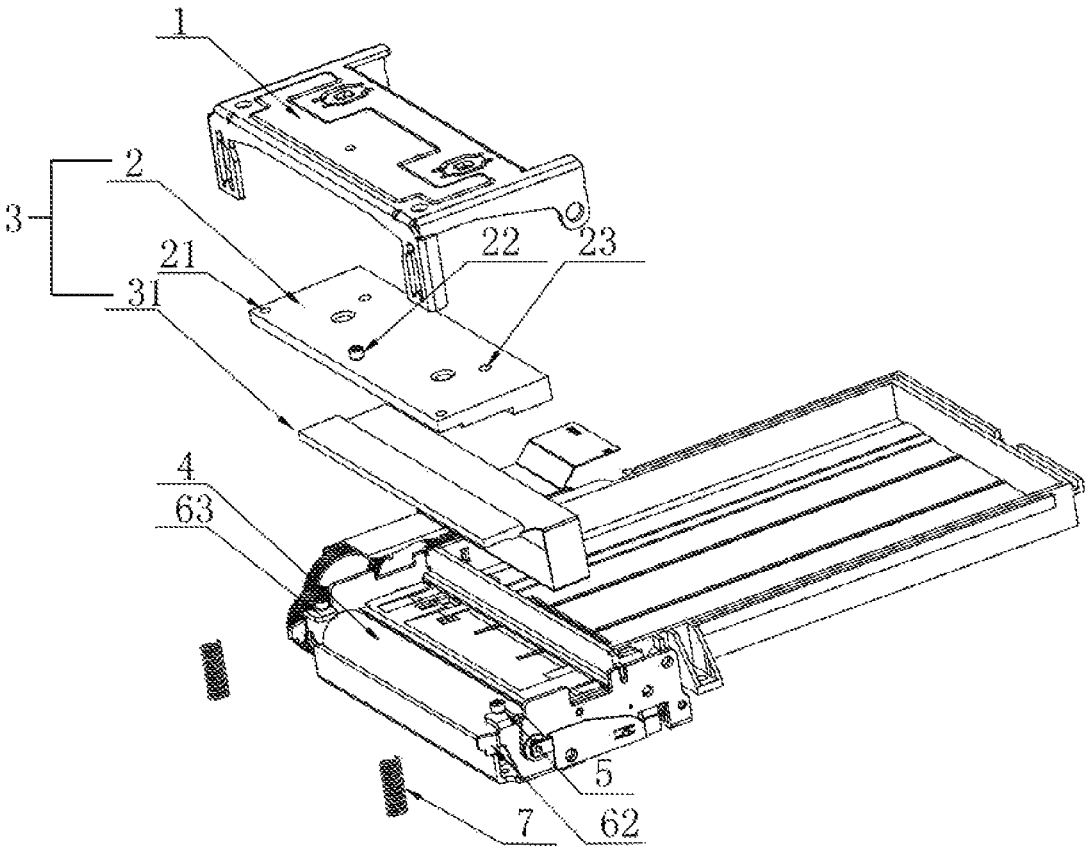
FIG. 3 is a schematic view showing an exploded state according to the first embodiment of the present disclosure.
Figure 4:
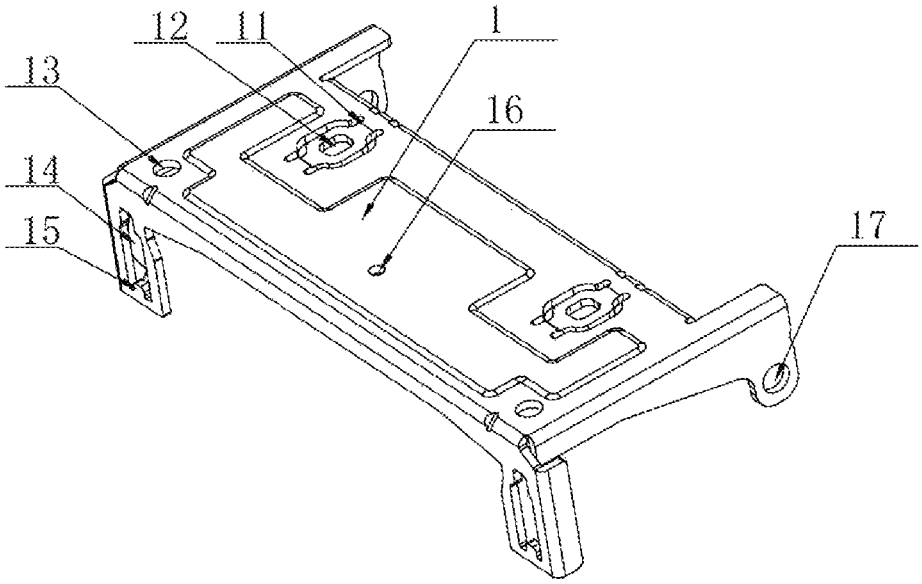
FIG. 4 is a perspective view of a holding member according to the first embodiment of the present disclosure.

Referring to FIGS. 2 and 3, a thermal printer comprises a base part 6, a pickup roller 61, a holding member 1, a printing device 3 and a platen roller 4. The printing device 3 is disposed along the width direction of the recording paper sheet, and the printing device 3 is configured for applying heat to thermal printing paper sheets to print text or images on thermal printing paper sheets. The printing device 3 comprises a resistive heating unit, and the printing device 3 is fixed on the holding member 1. Preferably, the printing device 3 further comprises a swing element 2 and a thermal head 31. The swing element 2 has a front end connected with the holding member 1 by the support pin 22 and a rear end connected with the holding member 1 by the deformable mechanism. And when the pressing force applied to the thermal head 31 by the recording paper sheet is uneven. The swing element 2 is capable of swinging about the support pin 22 serving as a fulcrum in order to even out the pressing force, and the deformable mechanism may be plastically deformed to keep the position of the swing element 2. A plurality of heating units may be provided. All of which may be disposed in a line along the width direction of the recording paper sheet and configured for applying heat to thermal recording paper sheets. So, texts or images can be printed on the recording paper sheets. The platen roller 4 is disposed opposite to the printing device 3 and is capable of performing rotation to feed the recording paper sheet clamped therebetween. The platen roller 4 is rotatably arranged at the front end of the base part 6 and can be rotated around the center shaft of the platen roller 4 on the base part 6. The outer surface of the platen roller 4 may be made of colloid and may be elastically deformed under the effect of a certain pressing force, and the middle part may be a rigid shaft.

A pivoting portion 17 pivotably connected with the base part 6 may be arranged at the rear end of the holding member 1. And the pivoting portion 17 may be fixedly arranged on the base part 6 and can be rotated around the base part 6. The pivoting portion 17 may be fixed on the base part 6 by a bolt, and the holding member 1 can be rotated around the bolt by the pivoting portion 17. The holding member 1 may be rotated around the base part 6 in a number of ways. For example, the base part 6 may be arranged with a rotatable pin shaft, and the pivoting portion 17 of the holding member 1 may be provided with a hole that accepts the pin shaft. An elastic element may be disposed between the holding member 1 and the base part 6. When the recording paper sheet is clamped between the printing device 3 and the platen roller 4, both the printing device 3 and the platen roller 4 may be in close contact with the recording paper sheet due to the elastic element. The elastic force provided by the elastic element can be applied to the holding member 1 towards the platen roller 4 to press the printing device 3. In the present embodiment, the elastic element in an embodiment may be a pressure spring 7. The pressure spring 7 may be mounted between the holding member 1 and the base part 6. The structure is described in detail as follows. The front end of the holding member 1 may extend downwardly to form a mounting frame 14. And a first pressure spring mounting portion 15 may be arranged on the mounting frame 14. The base part 6 may be arranged with the second mounting portion 62 for mounting the pressure spring 7, the second mounting portion 62 may be disposed at the upper end in the mounting frame 14, and the second mounting portion 62 may extend through the mounting frame 14 and the space for mounting the pressure spring 7 can be provided. The elastic element may be disposed at various positions, for example, disposed on the holding member 1, and its position is not limited to the position in the above solution.

The front end of the holding member 1 may be provided at two sides, respectively, with an accessing hole 13 and the accessing holes 13 are provided to facilitate the mounting of the engagement element 5 on the swing element 2. The front end of the holding member 1 may be provided at an intermediate position with a threaded hole 16, and a support pin 22 may be mounted in the threaded hole 16. The support pin 22 may be at least partly provided with screw threads fitting with the threaded hole 16. Due to the screw threads, the position of the support pin 22 relative to the holding member 1 may be adjusted. For example, when the support pin 22 is screwed lower, more area of the bottom of the support pin 22 may be exposed from the holding member 1.

Two deformable mechanisms are arranged at the rear end of the holding member 1, including a connecting portion 12 and a deformable portion 11, which are formed by hollowing out the holding member 1. The rear end of the swing element 2 may be fixed on the connecting portion 12. The holding member 1 may be made of a cold-rolled sheet having poor elasticity and may be readily plastically deformable.

The front end of the swing element 2 is connected to the holding member 1 by the support pin 22, and the rear end is connected with the connecting portion 12 of the deformable mechanism of the holding member 1 by the deformable mechanism. The support pin 22 is adjustably arranged on the swing element 2 due to the screw threads, thus the distance between the front end of the swing element 2 and the front end of the holding member 1 can be changed. Then the pre-tensioning force of the swing element 2 relative to the holding member 1 can be changed. When the pressing force applied to the swing element 2 at thermal head 31 by the recording paper sheet is uneven. The swing element 2 may swing about the support pin 22 serving as the fulcrum to even out the pressing force, and the deformable mechanism may be plastically deformed to keep the position of the swing element 2. The support pin 22 functions to transfer the pressing force generated by elastic components to the printing device 3, and a swing movement may be performed about the support pin 22 serving as the fulcrum to even out the pressing force when the pressing force applied to the thermal head 31 by the recording paper sheet is uneven. Based on the function of the support pin 22, it may be modified in many ways. For example, a supporting protrusion may be arranged on one side of the holding member 1 facing the swing element 2; alternatively, a supporting protrusion may be arranged on the upper side of the swing element 2 facing the holding member 1, which can provide the same function.

It is supposed that the force applied to the printing device 3 by the elastic component (the pressure spring 7) is F, and the deforming force of the deformable mechanism is F1. The rubber roller of the platen roller 4 may be deformed during printing. It is supposed that the supporting force at the area printed with lighter color is F2 and the supporting force at the area printed with deeper color is F2', the pressing force difference is $\Delta F = F2' - F2$. Preferably, $F > F1 > \Delta F$, in order to achieve better printing effect. When $F > F1$, a certain amount of deformation may be produced between the printing device 3 and the holding member 1 due to the force of the spring, such that the force of the springs on the left and right sides can be evenly applied on the printing device 3 to alleviate the problem that the force applied on the left and right sides is uneven due to springs and component errors. In the case of $F1 > \Delta F$, the pressing force difference caused by different amounts of deformations on two ends of the rubber roller can be avoided, a change in the position of the heating unit of the printing device 3 can be avoided, and the problem that the printing quality is affected due to the heating position which is displaced can be avoided, and thus the printing quality can be improved.

Figure 1:
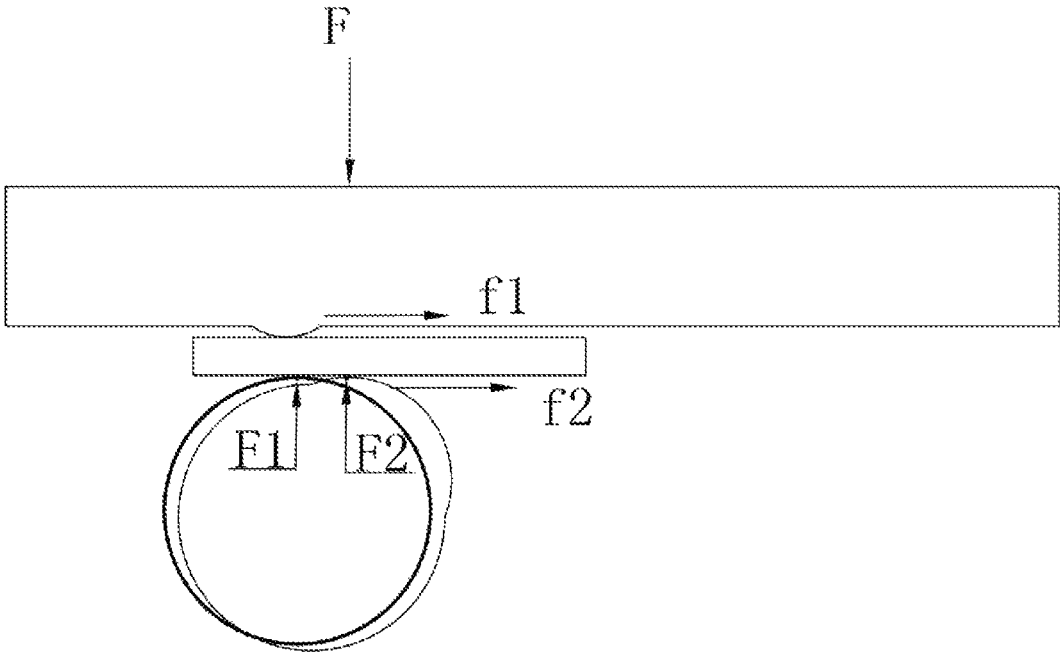
FIG.1 (Prior Art)
FIG. 1 is a schematic view illustrating applied forces in the prior art.

During the printing by means of the printer, when $F > F1$, in the case, that the force applied by the left and right springs are different, or, the printing paper sheet has a different thickness on the left and right sides, the printing device 3 can self-adaptively swing on the left and right sides to make the force between the printing device 3 and the recording paper sheet move even, and the printing device 3 can remain in place after swinging due to the deformable mechanism. Referring to FIG. 1, when the printer continues to perform printing after adjustment, in the case that a relatively deeper black is required to be printed on the left area, the printing device 3 continually partially heats the recording paper sheet, and the corresponding area of the printing paper sheet has increased temperature and gets hot. In such a case, the printing paper sheet transmitted frontward has an increased coefficient of friction, and thus the frictional drag f1 is increased. In this way, the force applied by the platen roller 4 to transmit the printing paper sheet is increased, and accordingly, the reactive force f2 is increased. In the case that the outer surface of the platen roller 4 is made of colloid and the circular cross-section of the colloid may be deformed (referring to FIG. 1) when the reactive force f2 is increased. Due to F1>ΔF, the deformable mechanism remains undeformed, the printing device 3 remains in place and thus the heating unit of the printing device 3 remains in place. In this way, it ensures that the original print line of the printing device 3 would not be offset and thus ensuring high printing quality. In this way, the existing problem that the printing quality may be affected by the offset of the print line caused by the change in position of the printing device 3 can be solved.

Figure 5:
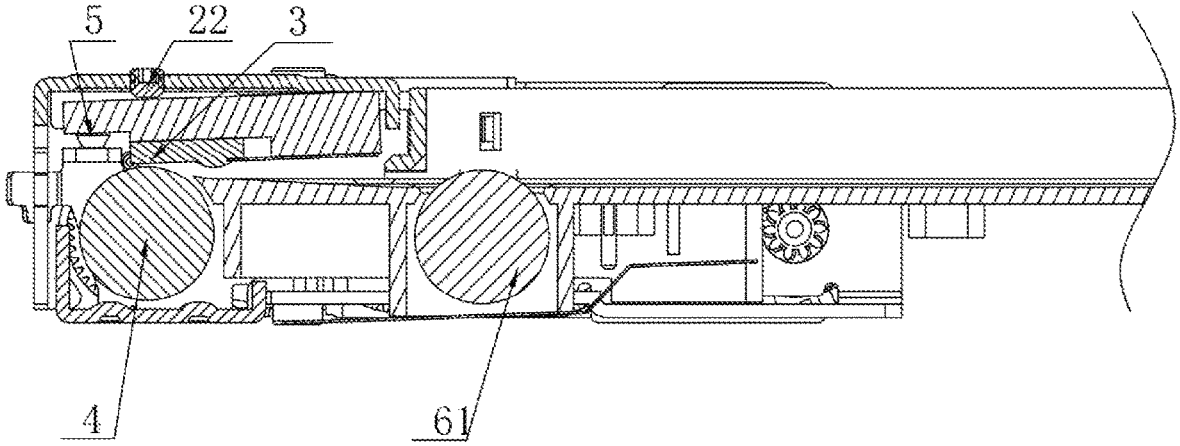
FIG. 5 is a cross-sectional view taken along symmetrical direction shown in FIG. 2.
Figure 6:
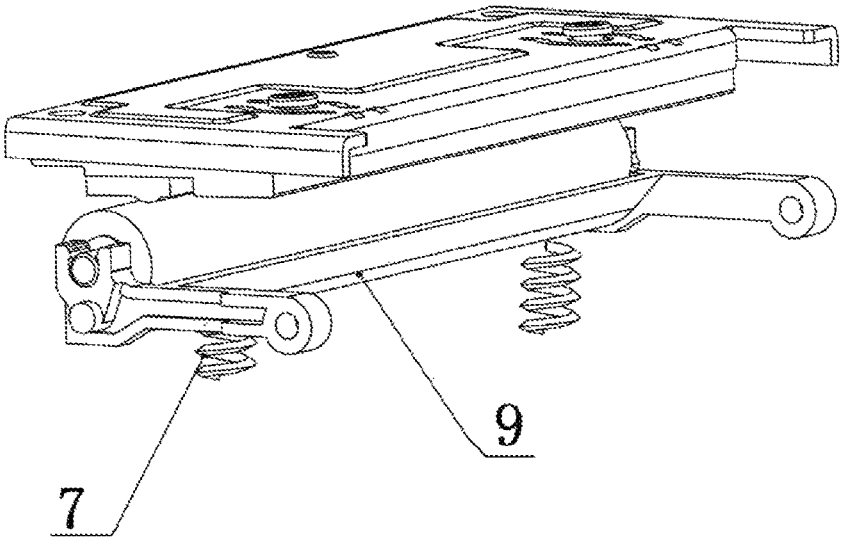
FIG. 6 is an exemplary view of a platen roller which is movably arranged according to another embodiment of the present disclosure.

Referring to FIG. 5, in the case that there is no recording paper sheet clamped between the printing device 3 and the platen roller 4, and the print line of the printing device 3 is parallel to the axis of the platen roller 4, the swing element 2 is located at an original position. During the printing employing the printer, the swing element 2 may swing due to the uneven force transferred from the recording paper sheet and is kept in position due to the deformable mechanism. When the recording paper sheet is moved away from the position between the printing device 3 and the platen roller 4, the holding member 1 may be rotated towards the platen roller 4 under the effect of the elastic component. Thus, the swing element 2 may be rotated to get closer to the platen roller 4. Consequently, under the effect of the engagement element 5, one end of the swing element 2 may abut on the base part 6, then the deformable mechanism arranged on the other end may be deformed due to the pressing force applied by the elastic element, and thus the other end may continue to move downwardly.

Consequently, the engagement elements 5 arranged on two ends of the swing element 2 may abut on the supporting portion 63 of the base part 6 such that the swing element 2 can be returned to the original position. Due to the engagement element 5, a determined gap can be preserved between the printing device 3 located at the original position and the platen roller 4. The engagement element 5 may be a screw, which passes through the accessing hole 13 of the holding member 1 and then is tightly screwed and fixed on the swing element 2. The bottom of the screw may abut on the supporting portion 63 of the base part 6. By adjusting the screw, the gap between the printing device 3 located at the original position and the platen roller 4 can be adjusted. The engagement element 5 may be modified in a number of ways. For example, it may be a protrusion that protrudes upwardly from the supporting portion 63 of the base part 6 and has a certain length; alternatively, it may be a protrusion which protrudes downwardly from the swing element 2 and has the same function.

Second Embodiment

In the second embodiment, the holding member 1 is fixedly arranged on the base part 6, the platen roller 4 is arranged at the front end of the holder 9, and the rear end of the holder 9 is movably arranged on the base part 6. Herein, the elastic element is capable of applying force to the holder 9 towards the printing device 3 to allow the platen roller 4 to get in close contact with the recording paper sheet. In the second embodiment, the platen roller 4 may be movably connected relative to the base part 6 in many ways. For example, a mounting groove may be provided on the base part 6, the two ends of the platen roller 4 may be arranged with a movable portion which can be engaged with the mounting groove, and the elastic component may be arranged below the platen roller 4 such that the generated pressing force can enable the platen roller 4 to get closer to the printing device 3. The holding member 1 is different from the first embodiment in that the mounting portion for mounting the pressure spring 7 is omitted. Others are similar to those arrangements in the first embodiment and are not repeated here.

The above is only some embodiments of the present disclosure, and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A thermal printer, comprising:

a base part;

a holding member arranged on the base part;

a printing device disposed along a width direction of a recording paper sheet; and a platen roller, wherein the platen roller and the printing device are oppositely disposed and are capable of performing rotation where the recording paper sheet is clamped between the platen roller and the printing device, to feed the recording paper sheet;

wherein one side of the printing device is connected with the holding member by a support pin, the other side of the printing device is connected with the holding member by a deformable mechanism; and the printing device is capable of swinging about the support pin serving as a fulcrum when a pressing force applied to the printing device by the recording paper sheet is uneven, in order to obtain even force distribution, and the deformable mechanism is capable of being plastically deformed to keep the printing device in position; wherein an elastic element is disposed between the holding member and the base part, and the elastic element is configured to allow both the printing device and the platen roller to get in close contact with the recording paper sheet when the recording paper sheet is clamped between the printing device and the platen roller.

2. The thermal printer according to claim 1, wherein the printing device comprises a swing element and a thermal head; one side of the swing element is connected with the holding member by the support pin, the other side of the swing element is connected with the holding member by the deformable mechanism; and the swing element is capable of swinging about the support pin serving as the fulcrum when a pressing force is applied to the thermal head by the recording paper sheet is uneven, in order to obtain even force distribution; and the deformable mechanism is capable of being plastically deformed to keep the swing element in position.

3. The thermal printer according to claim 2, wherein a support section of the support pin between the holding member and the swing element is adjustably located therebetween to change a pre-tensioning force between the swing element and the holding member.

4. The thermal printer according to claim 3, wherein the support pin is adjustably arranged on the holding member by a thread structure.

5. The thermal printer according to claim 2, wherein the support pin is located between the holding member and the swing element, and is arranged on one of the holding member and the swing element and protrudes towards the other one of the holding member and the swing element, in order to form the fulcrum for the support pin.

6. The thermal printer according to claim 2, wherein the deformable mechanism, comprising:

a deformable portion configured to be plastically deformed to keep a swing position of the swing element when the swing element swings; and a connecting portion for connecting the holding member and the swing element.

7. The thermal printer according to claim 6, wherein the deformable mechanism is arranged on the holding member, and includes the connecting portion and the deformable portion which are formed by hollowed-cuts of the holding member; and the swing element is fixed on the connecting portion.

8. The thermal printer according to claim 2, wherein, when the recording paper sheet is not clamped between the thermal head and the platen roller, and the thermal head is parallel to an axis of the platen roller, the thermal head is located at an original position; the deformable mechanism is configured to be plastically deformed to allow the thermal head to return back to the original position under an effect of an engagement element when the recording paper sheet is moved away from the position between the thermal head and the platen roller.

9. The thermal printer according to claim 8, wherein a gap between the thermal head and the platen roller is configured to be adjusted by a thread structure of the engagement element.

10. The thermal printer according to claim 9, wherein the engagement element is configured to keep a determined gap between the thermal head located at the original position and the platen roller.

11. The thermal printer according to claim 1, wherein a pivoting portion pivotably connected with the base part is arranged at the holding member; and the elastic element is configured to apply force to the holding member towards the platen roller to press the printing device and allow the printing device to get in close contact with the recording paper sheet.

12. The thermal printer according to claim 1, wherein the platen roller is movably arranged on the base part; and the elastic element is configured to apply force to the platen roller towards the printing device to allow it to get in close contact with the recording paper sheet.

13. The thermal printer according to any one of claim 1, wherein the elastic element is a pressure spring; the holding member is arranged with a first pressure spring mounting portion for mounting the pressure spring; the base part is arranged with a second mounting portion for mounting the pressure spring; and the pressure spring is located between the first pressure spring mounting portion and the second mounting portion.

14. The thermal printer according to claim 13, wherein the first pressure spring mounting portion is formed by a mounting frame which is hollowed out; the second mounting portion is disposed at the mounting frame; and the second mounting portion extends through the mounting frame to provide a space for mounting the pressure spring.

* * * * *